United States Patent [19]

Fortmann

[11] 4,445,815

[45] May 1, 1984

[54] TEMPERATURE REGULATION OF AIR CYCLE REFRIGERATION SYSTEMS

[75] Inventor: William E. Fortmann, West Simsbury, Conn.

[73] Assignee: United Technologies Corporation, Hartford, Conn.

[21] Appl. No.: 431,477

[22] Filed: Sep. 30, 1982

Related U.S. Application Data

[62] Division of Ser. No. 157,774, Jun. 9, 1980, Pat. No. 4,415,307.

[51] Int. Cl.[3] ..... F01D 17/08

[52] U.S. Cl. ..... 415/12; 415/22; 415/39; 415/158

[58] Field of Search ..... 415/12, 22, 28, 39, 415/47, 48, 156–158

[56] References Cited

U.S. PATENT DOCUMENTS

| | | | |
|---|---|---|---|
| 2,861,774 | 11/1958 | Buchi | 415/158 X |
| 2,874,642 | 2/1959 | Forrest | 415/157 X |
| 2,927,536 | 3/1960 | Rhoades | 415/48 |
| 2,957,424 | 10/1960 | Brundage et al. | 415/48 |
| 2,980,394 | 4/1961 | Rowlett et al. | 415/48 |
| 3,075,742 | 1/1963 | Aldag | 415/157 X |
| 3,382,809 | 5/1968 | Bookout et al. | 415/28 X |
| 3,975,911 | 8/1976 | Morgulis | 415/158 X |
| 3,994,620 | 11/1976 | Spraker et al. | 415/157 X |
| 4,324,526 | 4/1982 | Berchtold et al. | 415/48 |

FOREIGN PATENT DOCUMENTS

| | | | |
|---|---|---|---|
| 1224445 | 6/1960 | France | 415/157 |
| 1041842 | 9/1966 | United Kingdom | 415/157 |

*Primary Examiner*—Everette A. Powell, Jr.
*Attorney, Agent, or Firm*—John Swiatocha

[57] ABSTRACT

Temperature regulation of an air cycle refrigeration system is achieved by selectively adjusting the turbine stator geometry in response to the temperature of turbine airflow at a desired location. Such adjustment in stator geometry includes the selective positioning of a portion of the stator adjacent the turbine blades thereby controlling the amount of cooling produced by the turbine or the selective opening and closing of bypass ports provided in the turbine stator to control the flow of air through the turbine. Both of these adjustments in stator geometry are effected by an actuator comprising at least two members of differing coefficients of thermal expansion such as a bimetallic element.

6 Claims, 6 Drawing Figures

TEMPERATURE REGULATION OF AIR CYCLE REFRIGERATION SYSTEMS

DESCRIPTION

This is a division of application Ser. No. 157,774 filed on June 9, 1980, now U.S. Pat. No. 4,415,307, dated Nov. 15, 1983.

1. Technical Field

This invention relates to air cycle refrigeration systems and specifically to temperature regulation of such systems by means of selective adjustment in turbine stator geometry.

2. Background Art

Air cycle refrigeration systems, i.e. those systems wherein air cooled by the system also functions as a refrigerant, generally employ a turbine to expand, and cool the air. To control the system's output temperature, it has been the practice to tap a portion of uncooled air and channel that uncooled air directly to the output of the turbine, bypassing the turbine and achieving the desired turbine output temperature by mixing the cooled turbine exhaust with the uncooled air. In the prior art, the uncooled air bypasses the turbine through a conduit separate from the turbine itself, the amount of uncooled air trapped from the air supply being controlled by a temperature responsive valve disposed in the bypass conduit. Such systems have proven themselves adequate where ample space for housing the system is available. However, where the system is housed in a restricted space, as where the system is employed in cooling avionics in missiles and similar weapons, conduits and valves external to the turbine, such as the turbine bypass apparatus discussed herein are often unacceptable, rendering the system overly bulky for its intended use. Accordingly, means for regulating the output temperature of the air cycle system wherein the means are integral with the turbine while adding negligible bulk thereto are desirable.

While certain prior art turbines have been provided with temperature regulating means internal thereto, such as the turbines disclosed in U.S. Pat. Nos. 2,906,494 to McCarty et al and 3,814,313 to Beam, Jr. et al, such turbines are not employed for cooling purposes in refrigeration systems and the temperature regulating means employed in those turbines control the flow of cooling fluid through the turbine structure and do not regulate the temperature of the turbine output. The prior art also discloses various temperature regulating means such as thermostatic valves comprising a bimetallic element in selective sealing engagement with an orifice. Such devices are disclosed in U.S. Pat. Nos. 2,221,750 to Ashby et al; 2,475,473 to Brown; and 2,509,482 to Crise. However, while known per se or in combination with other apparatus such as electron tubes and combustion draft controls, such temperature regulating apparatus have not, as far as is known, heretofore been successfully integrated with expansion turbine structure in air cycle systems for turbine exhaust temperature control.

DISCLOSURE OF THE INVENTION

It is an object of the present invention to provide an improved means for regulating the turbine exhaust temperature in air cycle refrigeration systems.

It is another object of the present invention to provide such a temperature regulating means which is compact.

It is another object to provide such a temperature regulating means which is incorporated internally of the turbine.

It is another object to provide such a temperature regulating means which is characterized by an economy of structure.

These and other objects which will become more apparent from the following detailed description taken in connection with the appended claims and accompanying drawings, are achieved in the present invention by the provision of a temperature responsive actuator in an air cycle system cooling turbine, which actuator adjusts the turbine stator geometry in response to the temperature of airflow through the turbine. Such stator geometry adjustment comprises either an adjustment in clearance between the turbine rotor and the stator or the opening or closing of bypass ports provided in the stator, the bypass ports accommodating a select flow of uncooled inlet air which bypasses the turbine and is subsequently mixed with the chilled turbine exhaust to achieve a desired turbine outlet temperature. In both cases, the actuator comprises two joined members of differing coefficients of thermal expansion such as a bimetallic element in a truncated conical configuration.

BEST MODE FOR CARRYING OUT THE INVENTION

Figure 1:
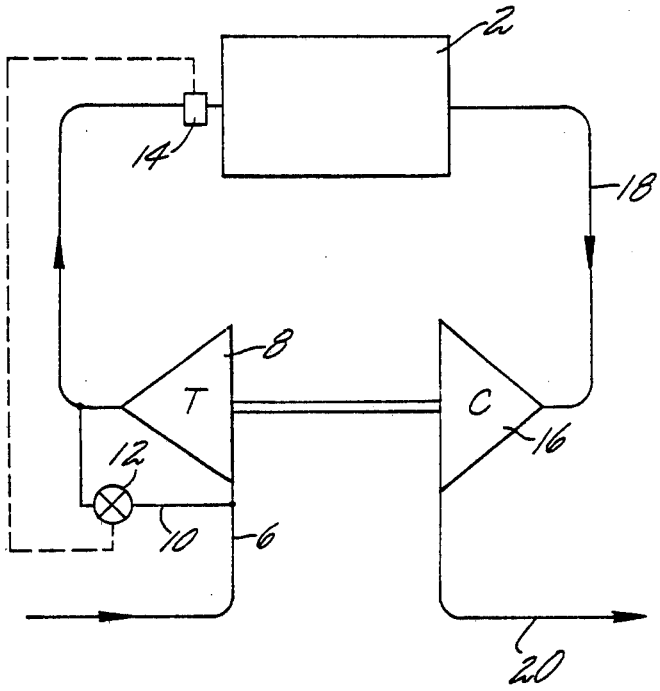
FIG. 1 is a schematic illustration of an air cycle refrigeration system such as that to which the present invention is adapted. However, in FIG. 1, a prior art means for selectively bypassing the turbine employed in the system is shown.

Referring to FIG. 1, an air cycle refrigeration system such as that used in airborne weapons such as cruise missles, and the like is shown. The system is employed to cool apparatus 2 such as the missle's avionics system by means of chilled air which acts as both the cooling medium and refrigerant for the system. Pressurized air is supplied to the system from a suitable source thereof, such as a compressor or from the intake of ram air through a suitable port (not shown). This pressurized air is fed to the system through inlet conduit 6, a portion of the pressurized air being fed to turbine 8 which expands and removes heat from the air which is then channeled to apparatus 2. As provided for in the prior art, another portion of inlet air is bypassed around turbine 8 through bypass line 10, this air being mixed with the chilled air from the turbine exhaust to achieve a desired temperature of the air which cools apparatus 2. To achieve a desired air temperature, a temperature regulating valve 12 is employed in the bypass line 10, valve 12 including a temperature sensing element 14 disposed, as for example at the inlet to apparatus 2 and, in response to the sensed temperature at that location, provides a signal to the valve indicative of the amount of valve opening required to achieve the desired temperature by a mixture of chilled and unchilled (bypass) air. Subsequent to cooling apparatus 2, the air is fed to compressor 16 through line 18, the air then being discharged from the system through outlet line 20. This system is generally known as a depressed ambient cycle refrigeration system. It will be understood that the present invention is employed with equal utility in any other air cycle refrigeration system employing a turbine for expansion and cooling of air.

Thus, while selectively bypassing the turbine for purposes of air temperature regulation has been known, such bypassing has been accomplished by means of conduits and temperature regulating valves separate from the cooling turbine. While such temperature regulation apparatus may be acceptable where the system is employed in an environment such as commercial aircraft wherein ample volume for housing the system is available, in applications such as cruise missles and the like, where the space available for the system is severely limited, such prior art systems may be unacceptably bulky.

Figure 3:
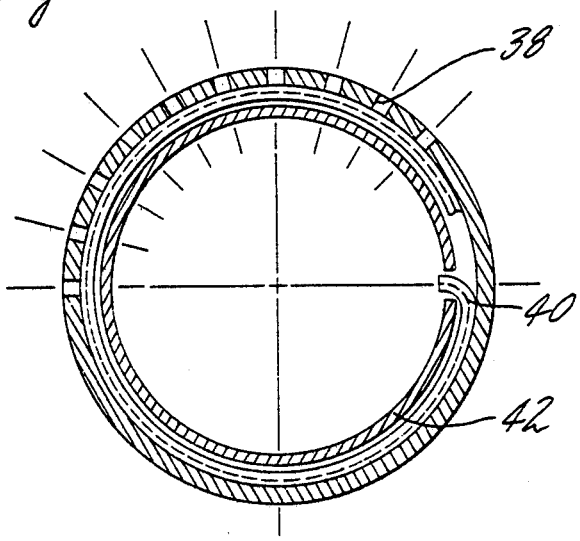
FIG. 3 is a sectional view taken along line 3—3 of FIG. 2.
Figure 2:
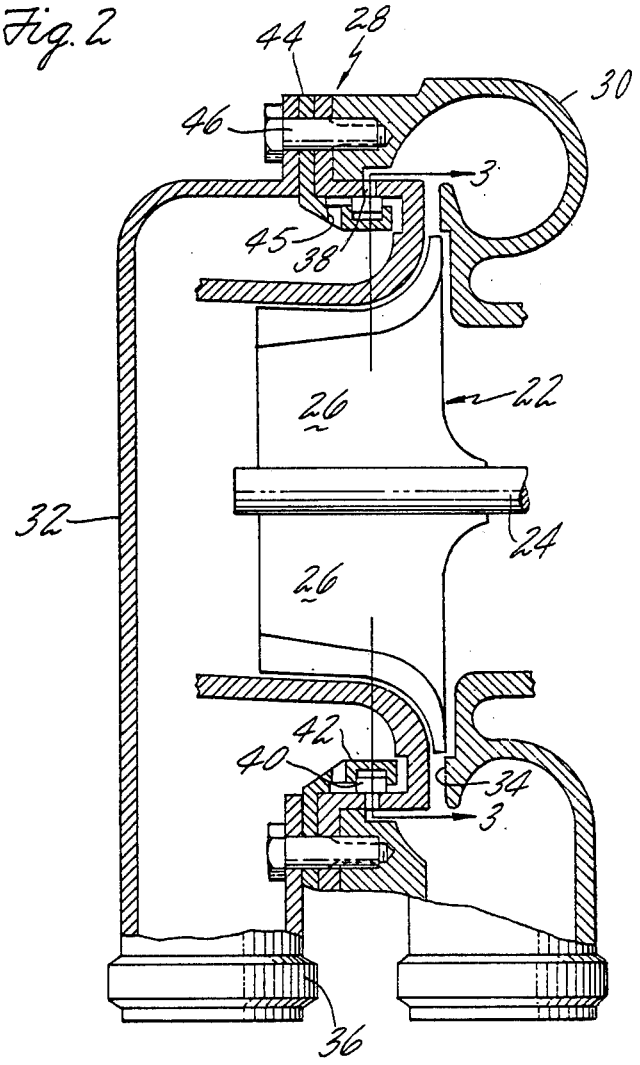
FIG. 2 is a sectioned elevation of the turbine section of a turbine-compressor unit employed in an air cycle system.

By the present invention, temperature regulation in air cycle refrigeration systems is provided internally to, and integral with the system's expansion turbine, detracting minimally from the compactness of the system. Referring to FIGS. 2 and 3, the turbine section of a turbine-compressor unit employed in an air cycle refrigeration system is illustrated. The turbine comprises a rotor 22 including shaft 24 and blades 26 rotatably mounted on bearings (not shown) and in general, for purposes of compactness, connected to the rotor of the compressor (not shown). Turbine rotor 22 is disposed within a stator 28, the geometry of which is variable by the temperature regulating means of the present invention to adjust the amount of heat removed by the turbine.

Stator 28 comprises inlet and outlet ducts 30 and 32 respectively, system inlet air being channeled to annular duct 30 through inlet 33, a portion of the air being fed through nozzles 34 to the interior of the turbine stator wherein the air performs work on rotor 22, whereby heat is removed from the air prior to being fed to the turbine exhaust 36 through outlet duct 32. To control the temperature of the air exhausted at 36, the turbine is provided with a plurality of bypass ports 38 disposed in the stator and communicating with inlet duct 30. As shown, an actuator or valve member 40 responsive to the temperature of the air in inlet duct 30 is disposed within the turbine stator generally radially inwardly from bypass ports 38. Valve member 40 comprises a plurality of joined members of differing coefficients of thermal expansion, i.e. a bimetallic member of generally annular shape (FIG. 3), and is received within a channel shaped end portion 42 of a valve guide 44 fixed to the turbine stator as by bolts 46. The valve guide maintains the axial alignment of valve member 40 with bypass ports 38. Secondary bypass ports 45 are disposed in guide 44 and provide fluid communication between exhaust duct 32 and bypass ports 38.

In operation, valve member 40, being in communication with turbine inlet air, flexes in response to changes in the inlet air temperature. This flexure of member 40 adjusts the radius and circumference thereof, thereby selectively opening and closing bypass ports 38 to selectively bypass rotor 22 with a portion of the turbine inlet air, that portion being channeled directly from the turbine inlet duct to the exhaust duct through bypass ports 38, around valve member 40 and through secondary bypass ports 45. The selective bypassing of the turbine rotor effects a mixing of that portion of the turbine inlet air which is cooled by the turbine with the uncooled bypass air to regulate the temperature of the air exhausted by the turbine.

Figure 4:
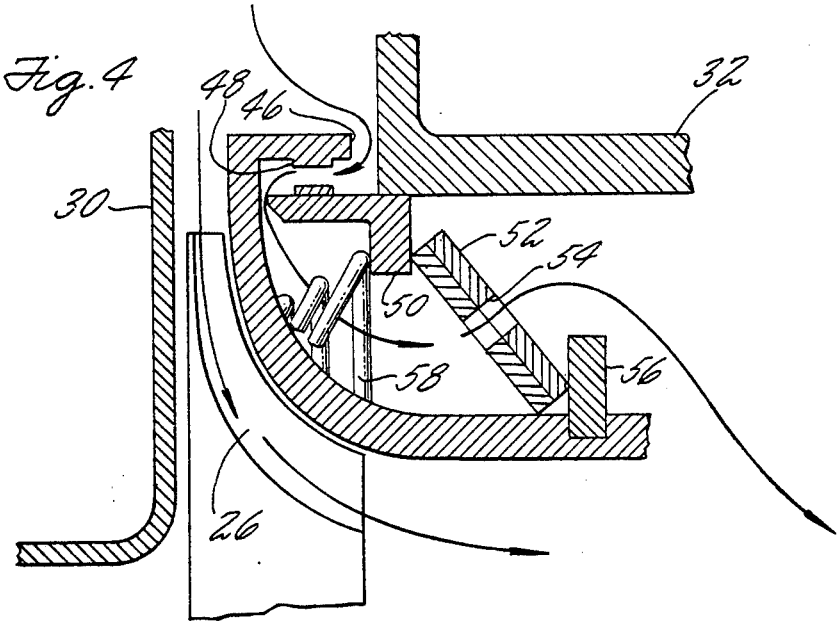
FIG. 4 is an enlarged, fragmentary, sectioned view of an embodiment of the temperature regulation means of the present invention.
Figure 5:
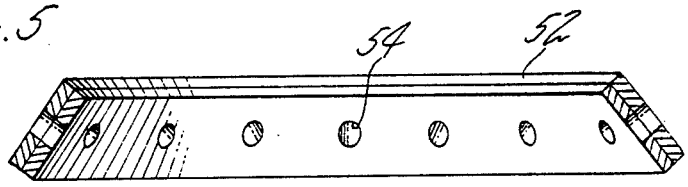
FIG. 5 is a sectioned elevation of a temperature responsive actuator employed in the embodiment of FIG. 4.

FIGS. 4 and 5 illustrate another embodiment of the present invention wherein a portion of the turbine inlet air bypasses the turbine rotor, thereby remaining uncooled for subsequent mixture with that portion of the inlet air cooled by the turbine for temperature regulation of the turbine exhaust. As illustrated in FIG. 4, in this embodiment, the turbine stator is provided with primary bypass ports 46 through which a portion of the inlet air is channeled. Secondary bypass ports 48 communicate with the primary ports and are selectively opened and closed by an axially adjustable annular stator portion 50 movable along a stationary portion of the stator. Adjustable portion 50 is actuated by actuator 52 comprising a plurality of joined members of differing coefficients of thermal conductivity, e.g. a bimetallic member, constructed in an annular, truncated, conical shape (FIG. 5). The actuator is provided with a plurality of apertures 54 to allow the passage of bypassed air therethrough. The stator is provided with a stationary stop 56, the actuator being disposed between and in engagement with valve member 50 and stop 56. Actuator 52 flexes in response to changes in the inlet air temperature, the flexure causing a variation in the slope and thickness of the actuator, thereby adjusting the axial position of valve member 50 for opening and closing secondary bypass ports 48 to effect a desired flow of bypass air. The engagement of valve member 50 with actuator 52 is maintained by resilient means or spring 58 compressed between member 50 and a stationary stator portion. Accordingly, it will be seen that closing of secondary bypass port 48 requires that actuator 52 overcome the force of spring 58.

In operation, a portion of the inlet air fed to the turbine through duct 30 is channeled to the turbine rotor blades 26 whereby heat from that portion of the air is removed. The remaining (bypass) inlet air is fed through the primary and secondary bypass ports 46 and 48 which are selectively opened and closed by flexure of valve member 50 is response to the temperature of the inlet air. From ports 46 and 48, the bypass air flows around valve member 50 through the apertures 54 in actuator 52 and finally mixes with the cooled turbine air for exhaust from the turbine at the desired temperature.

Figure 6:
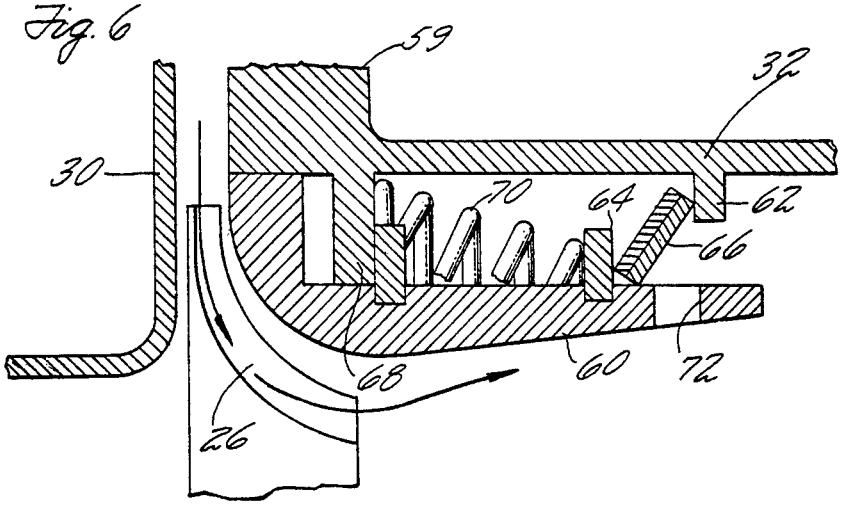
FIG. 6 is an enlarged, fragmentary, sectioned elevation of an alternate embodiment of the present invention.

FIG. 6 illustrates another embodiment of the present invention wherein the cooling air temperature is regulated by adjusting the clearance between the turbine rotor blades and stator, thereby adjusting the amount of heat removed from the turbine inlet air by the turbine without bypassing the turbine rotor. As shown, the turbine comprises inlet and outlet ducts 30 and 32 and a stator within which the rotor including blades 26 is disposed. The stator includes a stationary portion 59 which may comprise an end portion of duct 32 and an adjustable portion 60 adjacent the blade tips and movable with respect to the stationary portion along an inner surface thereof. The stationary and adjustable portions include stops or detents 62 and 64 respectively, between which an actuator 66 is disposed. Actuator 66 comprises a plurality of joined members of differing coefficients of thermal expansion such as a bimetallic member and in this embodiment, is constructed in a generally annular, truncated conical shape similar to the actuator illustrated in FIG. 5. The stationary stator portion includes a second stop 68 thereon, resilient means or coil spring 70 being compressed between stops 68 and 64.

In operation, actuator 66 is exposed to a desired temperature such as the inlet or ambient air temperature or the exhaust temperature as by exposure to the exhaust air through port 72 in movable stator member 60. In response to changes in this temperature, actuator 66 flexes, changing the slope and thickness thereof thereby adjusting the position of adjustable stator member 60 with respect to the stationary portion 59 of the stator. This positioning of member 60 varies the clearance between turbine blades 26 and that member to achieve the desired cooling of the entire inlet airstream, thereby controlling the temperature of the turbine exhaust air.

It will thus be appreciated that by the temperature regulating means of the present invention, the temperature of cooling air provided by an air cycle refrigeration system is controlled entirely within the turbine requiring no additional bypass conduits or valves exteriorly of the turbine, thereby enhancing the compactness of the system for utilization within restricted volumes such as within missles and the like. The provision of an actuator formed from a plurality of joined members of differing coefficients of thermal expansion enhances the economy of construction of the temperature regulating system while insuring the accuracy thereof. Utilization of such an actuator as a valve element further enhances the compactness and economy of construction of the temperature regulating means.

Although the invention has been shown and described with respect to detailed embodiments thereof, it should be understood by those skilled in the art that various changes and omissions in form and detail may be made therein without departing from the spirit and the scope of the invention.

Having thus described the invention, what is claimed is:

1. A turbine for an air cycle refrigeration system, said turbine comprising a rotor provided with a plurality of blades and a stator having fixed and adjustable portions thereof said stator receiving air through an inlet thereof, said air being expanded and cooled in said turbine and delivered from said turbine through an outlet thereof, said turbine being characterized by an actuator disposed interiorly of said turbine, said actuator comprising a bimetallic annulus of truncated conical shape connected to said fixed and adjustable stator portions, flexure of said bimetallic annulus in response to the temperature of airflow through the turbine axially varying the geometry of said annulus to adjust the relative, axial disposition of said fixed and adjustable stator portions for adjusting the airflow through said turbine, thereby varying the amount of heat removed from said airstream.

2. The turbine of claim 1 characterized by said adjustable stator portion comprising a portion of said stator adjacent tip portions of said rotor blades whereby said adjustment in the relative disposition of said fixed and adjustable stator portions comprises an adjustment in the clearance between the turbine rotor blades and stator.

3. The turbine of claim 1 further characterized by resilient means biasing said adjustable member into engagement with said bimetallic member.

4. The turbine of claim 1 further characterized by said fixed stator portion including at least one bypass port through which a portion of said air selectively bypasses said turbine rotor from said inlet to said outlet end said adjustable portion comprising a closure member for said bypass ports, adjustment of said relative disposition between said fixed and adjustable portions varying the effective cross-sectional area of said bypass ports and the flow therethrough.

5. The turbine of claim 4 characterized by said bimetallic annulus being disposed coaxially with respect to said turbine and said closure member being axially adjustable whereby variation in geometry of said annulus effects an axial displacement of closure member.

6. The turbine of claim 5 wherein said annulus includes a plurality of apertures therein said apertures accommodating said bypass airflow therethrough.

* * * * *